US006725678B2

(12) United States Patent
Chang et al.

(10) Patent No.: US 6,725,678 B2
(45) Date of Patent: Apr. 27, 2004

(54) REFRIGERATOR WITH MULTIPURPOSE STORAGE CHAMBER AND CONTROL METHOD THEREOF

(75) Inventors: Eui-Young Chang, Suwon (KR); Sung-Cheol Kang, Kwangiu (KR); Seong-Wook Jeong, Kwangiu (KR)

(73) Assignee: Samsung Electronics Co. Ltd., Suwon-si (KR)

( * ) Notice: Subject to any disclaimer, the term of this patent is extended or adjusted under 35 U.S.C. 154(b) by 0 days.

(21) Appl. No.: 10/255,009

(22) Filed: Sep. 26, 2002

(65) Prior Publication Data

US 2003/0097850 A1 May 29, 2003

(30) Foreign Application Priority Data

Nov. 27, 2001 (KR) ..... 2001-74293

(51) Int. Cl.[7] ..... F25D 21/06; F25D 17/00
(52) U.S. Cl. ..... 62/156; 62/276
(58) Field of Search ..... 62/156, 276, 179, 62/180, 442

(56) References Cited

U.S. PATENT DOCUMENTS 4,569,206 A * 2/1986 Mitani et al. ..... 62/156
6,185,948 B1 2/2001 Niki et al.
6,330,803 B1 * 12/2001 Shin ..... 62/156

FOREIGN PATENT DOCUMENTS

JP 11142042 * 5/1999
JP 2002213854 * 7/2002

* cited by examiner

*Primary Examiner*—Melvin Jones
(74) *Attorney, Agent, or Firm*—Staas & Halsey LLP

(57) ABSTRACT

A refrigerator with a multipurpose storage chamber and a control method. In the refrigerator, the flow of cool air to the multipurpose storage chamber is selectively controlled in accordance with a variety of operational modes. In order to accomplish such a cool air flow control, a refrigerating compartment fan and a damper are provided at positions above a refrigerating compartment evaporator. In addition, a flap, controlled at an open angle thereof, is provided at the inlet of an air guide path guiding the cool air to the multipurpose storage chamber. The multipurpose storage chamber of this refrigerator can thus effectively be used to store a variety of foods in accordance with storage characteristics of the foods. In addition, a thawing mode operation of the refrigerator is performed under the condition that it is not necessary to perform a refrigerating compartment cooling operation. It is thus possible to prevent an excessive increase in the temperature of the refrigerating compartment caused by an operation of the defrosting heater during such a thawing mode.

22 Claims, 9 Drawing Sheets

REFRIGERATOR WITH MULTIPURPOSE STORAGE CHAMBER AND CONTROL METHOD THEREOF

CROSS-REFERENCE TO RELATED APPLICATIONS

This application claims the benefit of Korean Application No. 2001-74293, filed Nov. 27, 2001, in the Korean Industrial Property Office, the disclosure of which is incorporated herein by reference.

BACKGROUND OF THE INVENTION

1. Field of the Invention

The present invention relates, in general, to refrigerators with a multipurpose storage chamber and a control method thereof, and more particularly, to a refrigerator having a multipurpose storage chamber in its refrigerating compartment and a control method thereof, which controls the flow of cool air to the multipurpose storage chamber.

2. Description of the Prior Art

In conventional refrigerators using an independent temperature controller (ITC), the interior of the cabinet is divided into a freezing compartment and a refrigerating compartment by a partition wall. Two doors are hinged to the cabinet at positions in the front of the two compartments, thus allowing a user to open the freezing compartment and/or the refrigerating compartment as desired. In such a refrigerator of the ITC type, an evaporator and a fan are provided at the rear portion of the cabinet at a position corresponding to each of the refrigerating and freezing compartments, thus independently supplying cool air to an associated compartment. A defrosting heater is provided at each of the two evaporators installed at the two compartments.

In the conventional refrigerators, the freezing compartment preferably stores frozen food therein, while the refrigerating compartment preferably stores cold food therein. Additional storage chambers may be provided in the refrigerating compartment. For example, a vegetable storage chamber is provided at the lower portion of the refrigerating compartment for storing vegetables and/or fruits therein.

However, the temperature of the vegetable storage chamber varies in a similar manner to a variation in the temperature of the refrigerating compartment. It is thus necessary to provide a technique of effectively storing a variety of foods in accordance with different storage characteristics of the foods. For example, some foods, such as fish, are required to be kept cold in the refrigerating compartment rather than stored in the freezing compartment, but are not suitable to be kept in the vegetable storage chamber. Therefore, in order to more effectively store such foods in the refrigerating compartment while maintaining their freshness for a desired period of time, it is necessary to provide, in the refrigerating compartment, an additional storage chamber that can reduce its temperature to a desired point within a short period of time.

SUMMARY OF THE INVENTION

Accordingly, it is an object of the present invention to provide a refrigerator with a multipurpose storage chamber and a control method thereof, which controls the flow of cool air to the multipurpose storage chamber provided in the refrigerating compartment in accordance with different storage characteristics of foods stored in the multipurpose storage chamber.

Additional objects and advantages of the invention will be set forth in part in the description which follows and, in part, will be obvious from the description, or may be learned by practice of the invention.

The foregoing and other objects of the present invention are achieved by providing a refrigerator, comprising: a multipurpose storage chamber provided in a refrigerating compartment; and a cool air supply device controlling a flow of cool air to the multipurpose storage chamber in accordance with a selected operational mode.

The foregoing and other objects of the present invention are also achieved by providing a method of controlling a refrigerator with a multipurpose storage chamber provided in the refrigerating compartment and a cool air supply device controlling the flow of cool air to the multipurpose storage chamber, comprising: determining an operational mode selected by a user; and selectively controlling the flow of cool air to the multipurpose storage chamber or the refrigerating compartment by an operation of the cool air control device in accordance with a selected operational mode, thus controlling the temperature of the multipurpose storage chamber.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE INVENTION

Figure 1:
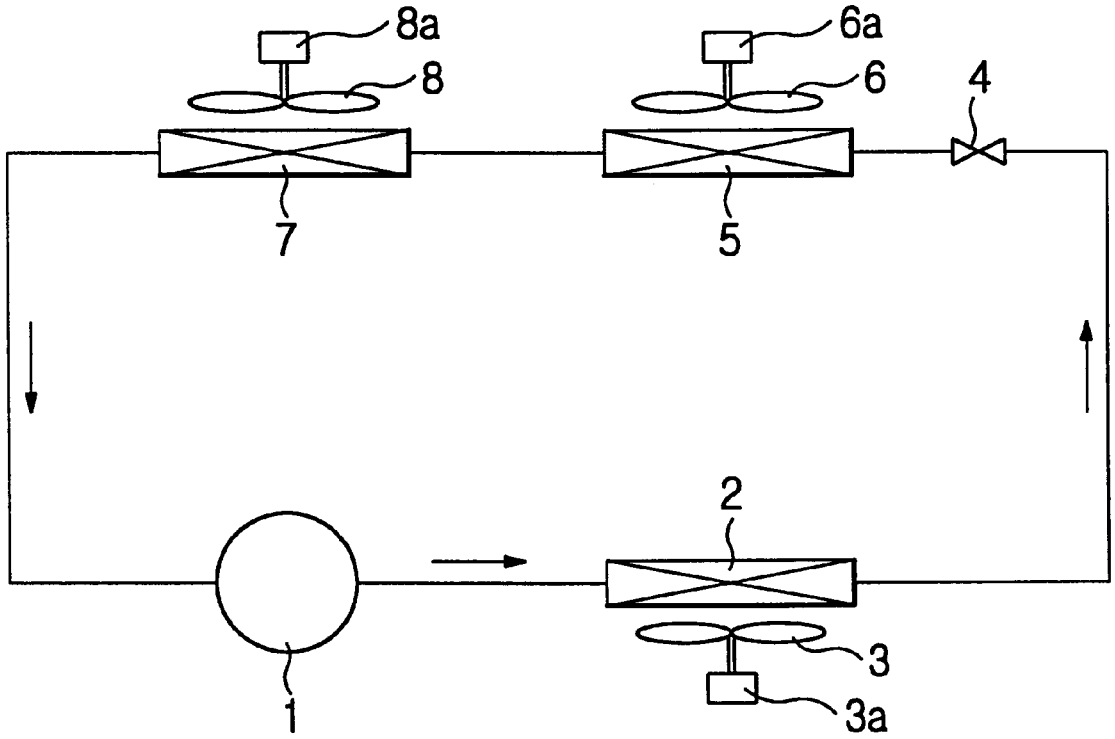
FIG. 1 illustrates a refrigerating cycle used in refrigerators according to an embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

As illustrated in FIG. 1, the refrigerating cycle typically used in a refrigerator of the ITC type regarding the present invention comprises a compressor 1, a condenser 2, an expansion valve 4, a refrigerating compartment evaporator 5, and a freezing compartment evaporator 7, which are connected to each other by a refrigerant line to form a closed system. The refrigerating cycle also has a blower fan motor 3*a* driving a blower fan 3, a refrigerating fan motor 6*a* driving a refrigerating compartment fan 6, and a freezing fan motor 8*a* driving a freezing compartment fan 8.

Figure 2:
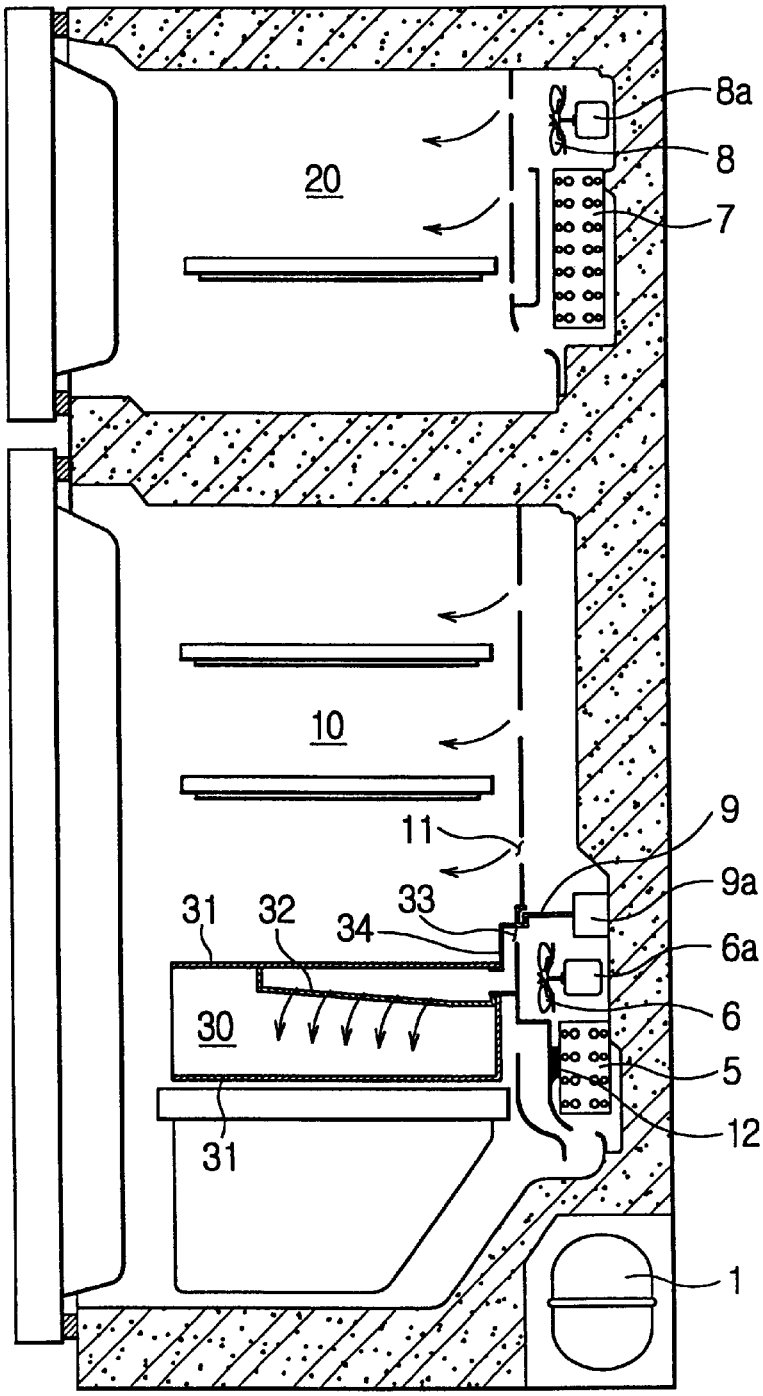
FIG. 2 is a sectional view illustrating the construction of a refrigerator with a multipurpose storage chamber according to an embodiment of the present invention.

FIG. 2 is a sectional view, illustrating the construction of a refrigerator with a multipurpose storage chamber according to an embodiment of the present invention. As illustrated in the drawing, the cabinet of this refrigerator is divided in its interior into a refrigerating compartment 10 and a freezing compartment 20 which are respectively positioned at the lower and upper portions in the cabinet. A multipurpose storage chamber 30, as an additional storage chamber, is provided in the refrigerating compartment 10. The casing of the multipurpose storage chamber 30 is made of a thermal insulating material 31, and is detachably mounted to an air guide path 34 that guides cool air to the chamber 30. A flap 33 is hinged at an end thereof to the inlet of the guide path 34 such that the flap 33 is controlled in its open angle. An inclined panel 32, made of a thermal insulating material and having a plurality of air guide holes, is arranged at the upper portion of the multipurpose storage chamber 30. Cool air flowing from the guide path 34 is introduced into the multipurpose storage chamber 30 through the air guide holes of the inclined panel 32.

The refrigerator also has a cool air supply device controlling the flow of cool air to the multipurpose storage chamber 30 in accordance with a selected operational mode. This cool air supply device comprises a refrigerating compartment fan 6, which is installed in back of the flap 33 and is rotated by a refrigerating fan motor 6*a*. A refrigerating compartment evaporator 5, with a defrosting heater 12, is provided at a position under the refrigerating compartment fan 6.

A damper 9 is provided at a position above the refrigerating compartment fan 6 to selectively supply cool air from the fan 6 to the refrigerating compartment 10. The damper 9 is opened or closed by a damper motor 9*a*.

Figure 3:
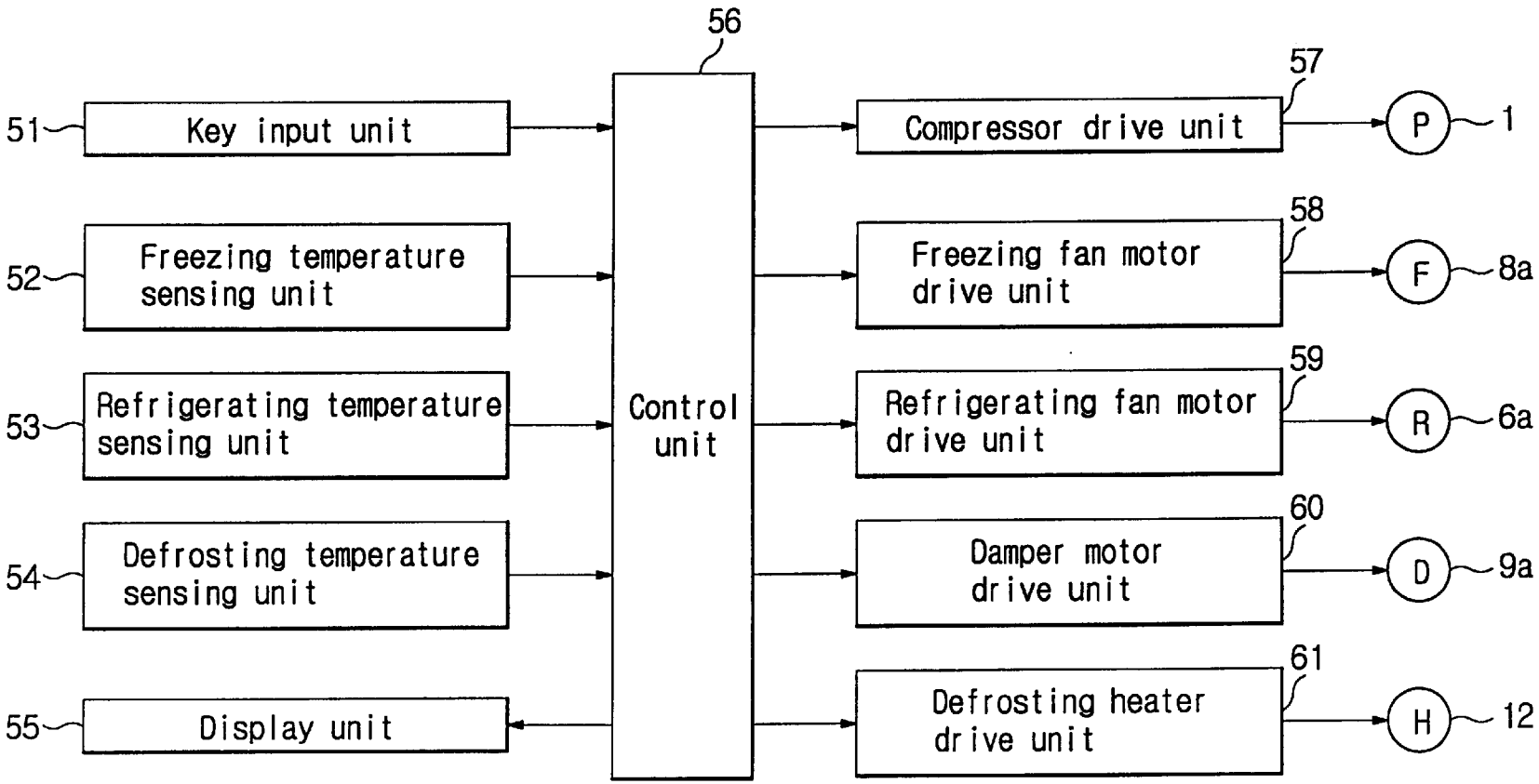
FIG. 3 is a block diagram of the control units of the refrigerator with the multipurpose storage chamber shown in FIG. 2.

FIG. 3 is a block diagram of the refrigerator according to FIG. 2. As illustrated in this drawing, a control unit 56 of the cool air supply device controlling the flow of cool air to the multipurpose storage chamber 30 is connected at its input ports to a key input unit 51, a freezing temperature sensing unit 52, a refrigerating temperature sensing unit 53, and a defrosting temperature sensing unit 54. The control unit 56 is also connected at its output ports to a display unit 55, a compressor drive unit 57, a freezing fan motor drive unit 58, a refrigerating fan motor drive unit 59, a damper motor drive unit 60, and a defrosting heater drive unit 61.

The key input unit 51 is provided with a plurality of function keys to allow a user to input desired operational modes and desired reference temperatures of the two compartments 10 and 20 and the multipurpose storage chamber 30.

The freezing temperature sensing unit 52 and the refrigerating temperature sensing unit 53 respectively sense the temperatures of the freezing compartment 20 and the refrigerating compartment 10, and output temperature signals to the control unit 56.

The defrosting temperature sensing unit 54 senses the temperature of the refrigerating compartment evaporator 5 during a defrosting mode carried by the activated defrosting heater 12, and outputs a temperature signal to the control unit 56.

The five drive units 57, 58, 59, 60, and 61 connected to the output ports of the control unit 56 respectively drive the compressor 1, the freezing fan motor 8*a*, the refrigerating fan motor 6*a*, the damper motor 9*a*, and the defrosting heater 12 under the control of the control unit 56.

The control unit 56 controls the flow of cool air to the multipurpose storage chamber 30 in accordance with a variety of operational modes of the refrigerator. The operational modes of the refrigerator include a constant temperature mode, a quick refrigerating mode, and a thawing mode. In the constant temperature mode, the control unit 56 normally operates the refrigerator in accordance with preset reference temperatures and sensed temperatures of the two compartments 10 and 20 and the multipurpose storage chamber 30. In the quick refrigerating mode selected by a user operating a quick refrigerating function key of the key input unit 51, the control unit 56 operates the refrigerator such that a large quantity of cool air is supplied to the multipurpose storage chamber 30 within a short period of time, thus quickly reducing the temperature of the chamber 30. In the thawing mode selected by the user operating a thawing function key of the key input unit 51, the control unit 56 activates the defrosting heater 12, thus supplying heated air from the heater 12 to the multipurpose storage chamber 30 and increasing the temperature of the chamber 30.

Figure 4:
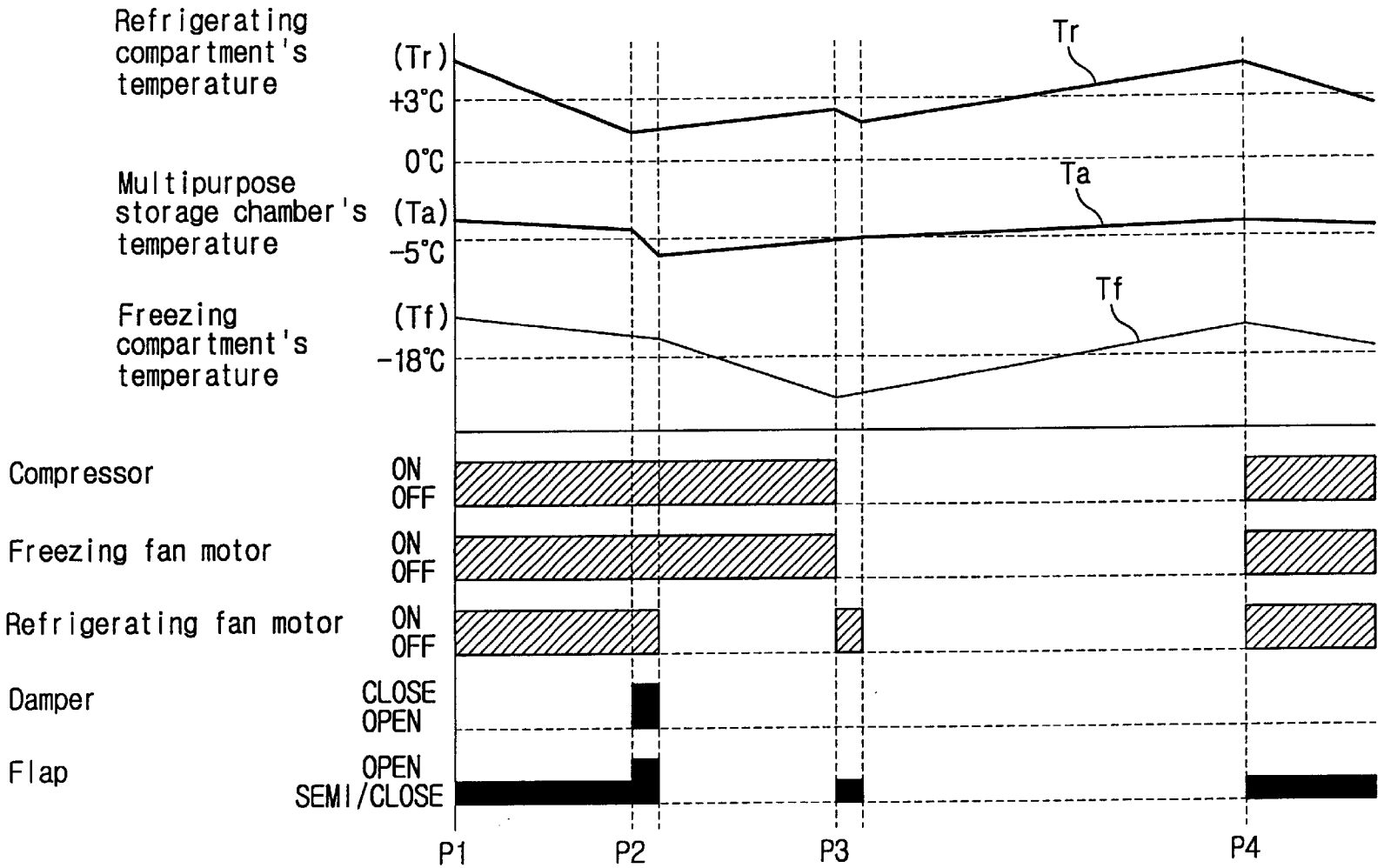
FIG. 4 is a graph illustrating the temperatures of the refrigerating compartment, the freezing compartment and the multipurpose storage chamber during a constant temperature mode operation of the refrigerator shown in FIG. 2.

In the constant temperature mode, the control unit 56 operates the compressor 1, the refrigerating compartment fan 6 and the freezing compartment fan 8 in accordance with the preset reference temperatures and sensed temperatures of the two compartments 10 and 20 and the multipurpose storage chamber 30. During a refrigerating compartment cooling operation of the constant temperature mode, the control unit 56 opens the damper 9, allowing most of the cool air from the refrigerating compartment evaporator 5 to flow to the refrigerating compartment 10. In such a case, only a small quantity of cool air flows through the flap 33. This means that the quantity of cool air flowing to the multipurpose storage chamber 30 is not sufficient. During such a constant temperature mode, the temperature Ta of the multipurpose storage chamber 30 is higher than the temperature Tr of the refrigerating compartment 10, and the two temperatures Ta and Tr vary in a similar manner, as illustrated in the graph of FIG. 4.

Figure 5:
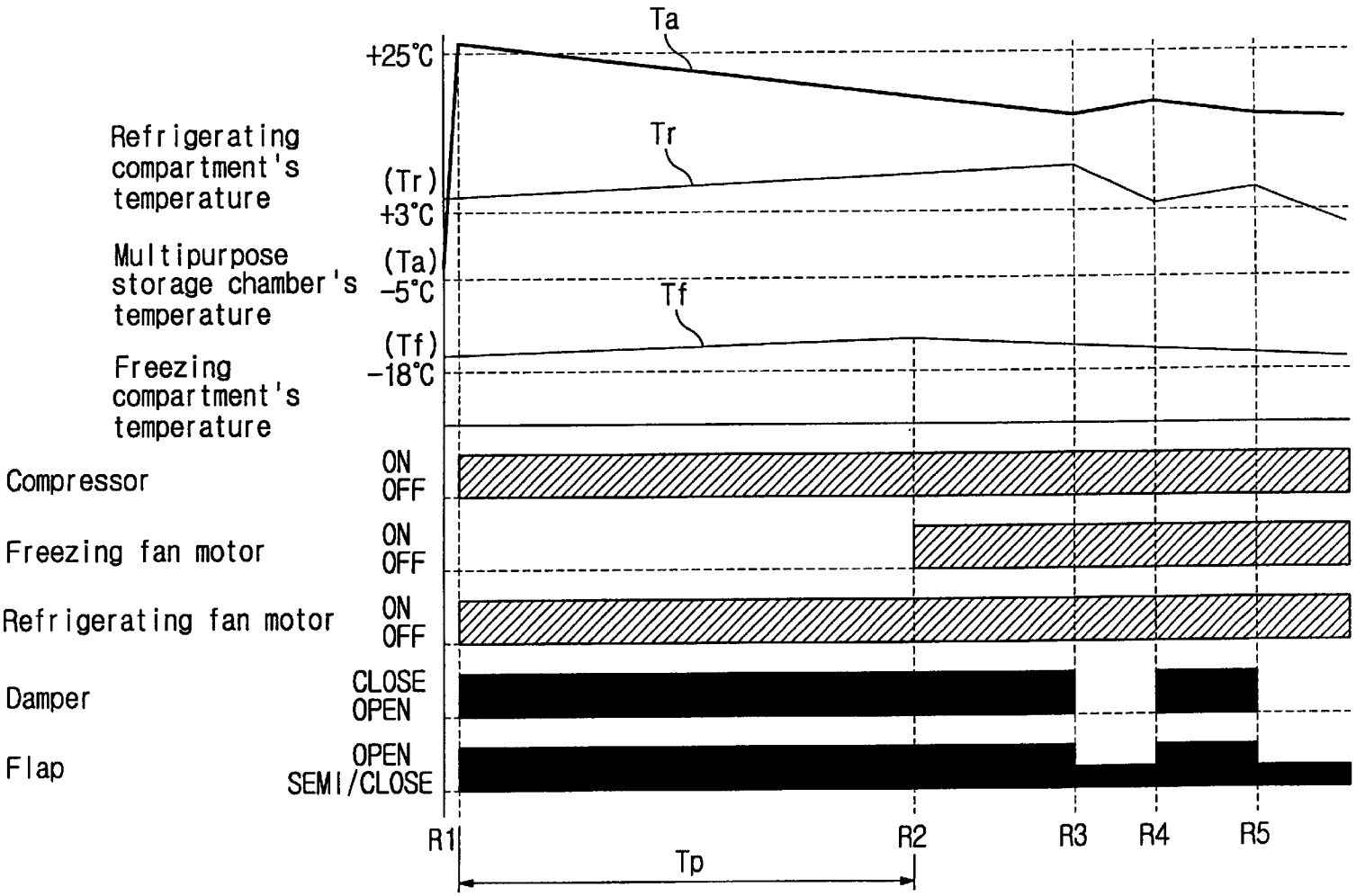
FIG. 5 is a graph illustrating the temperatures of the two compartments and the multipurpose storage chamber during a quick refrigerating mode operation of the refrigerator shown in FIG. 2.

In the quick refrigerating mode, the control unit 56 performs a cooling operation for a predetermined period of time while turning on both the compressor 1 and the refrigerating fan motor 6*a* and closing the damper 9. In such a case, most of cool air from the refrigerating compartment evaporator 5 flows to the multipurpose storage chamber 30 through the flap 33, which is open at a wide angle. When a user selects such a quick refrigerating mode after storing hot food in the multipurpose storage chamber 30, the temperature Ta of the chamber 30 is quickly reduced within a short period of time, as illustrated in the graph of FIG. 5.

Figure 6:
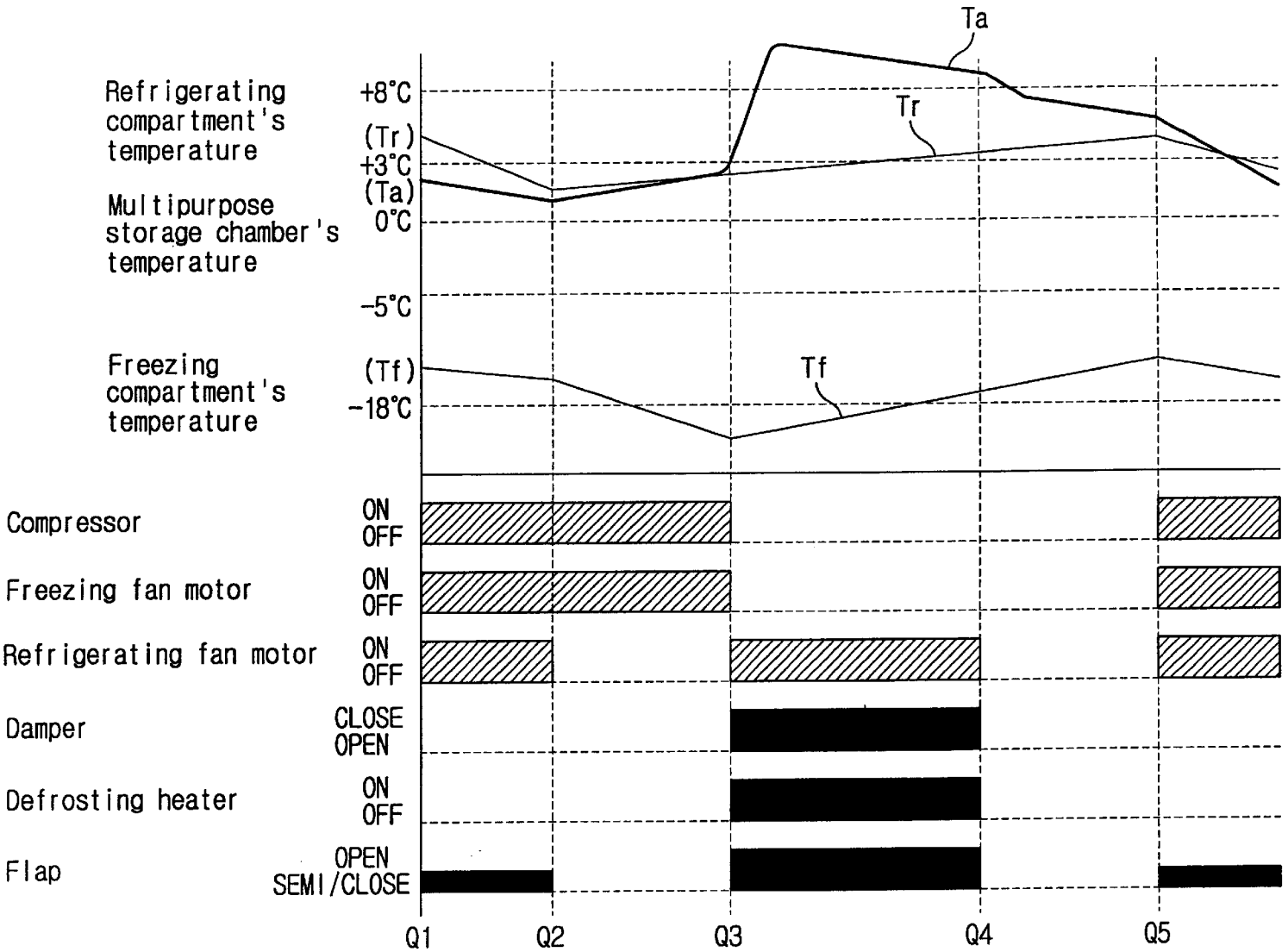
FIG. 6 is a graph illustrating the temperatures of the two compartments and the multipurpose storage chamber during a thawing mode operation of the refrigerator shown in FIG. 2.

In the thawing mode, the compressor 1 is turned off, while both the defrosting heater 12 and the refrigerating fan motor 6*a* are turned on, and the damper 9 is closed. Heated air from the defrosting heater 12 is thus supplied to the multipurpose storage chamber 30 due to the blowing force of the refrigerating compartment fan 6, and thaws frozen food stored in the chamber 30. Such a thawing mode is performed under the condition that the temperature of the refrigerating compartment 10 does not exceed the preset reference point of said compartment 10, thus preventing an excessive increase in the temperature of the compartment 10 caused by an operation of the defrosting heater 12 during the thawing mode. When the defrosting heater 12 is turned on during such a thawing mode, the temperature Ta of the multipurpose storage chamber 30 is quickly increased, as illustrated in the graph of FIG. 6.

The method of controlling the operation of the refrigerator having such a multipurpose storage chamber according to this invention will be described herein below with reference to the drawings.

Figure 7A:
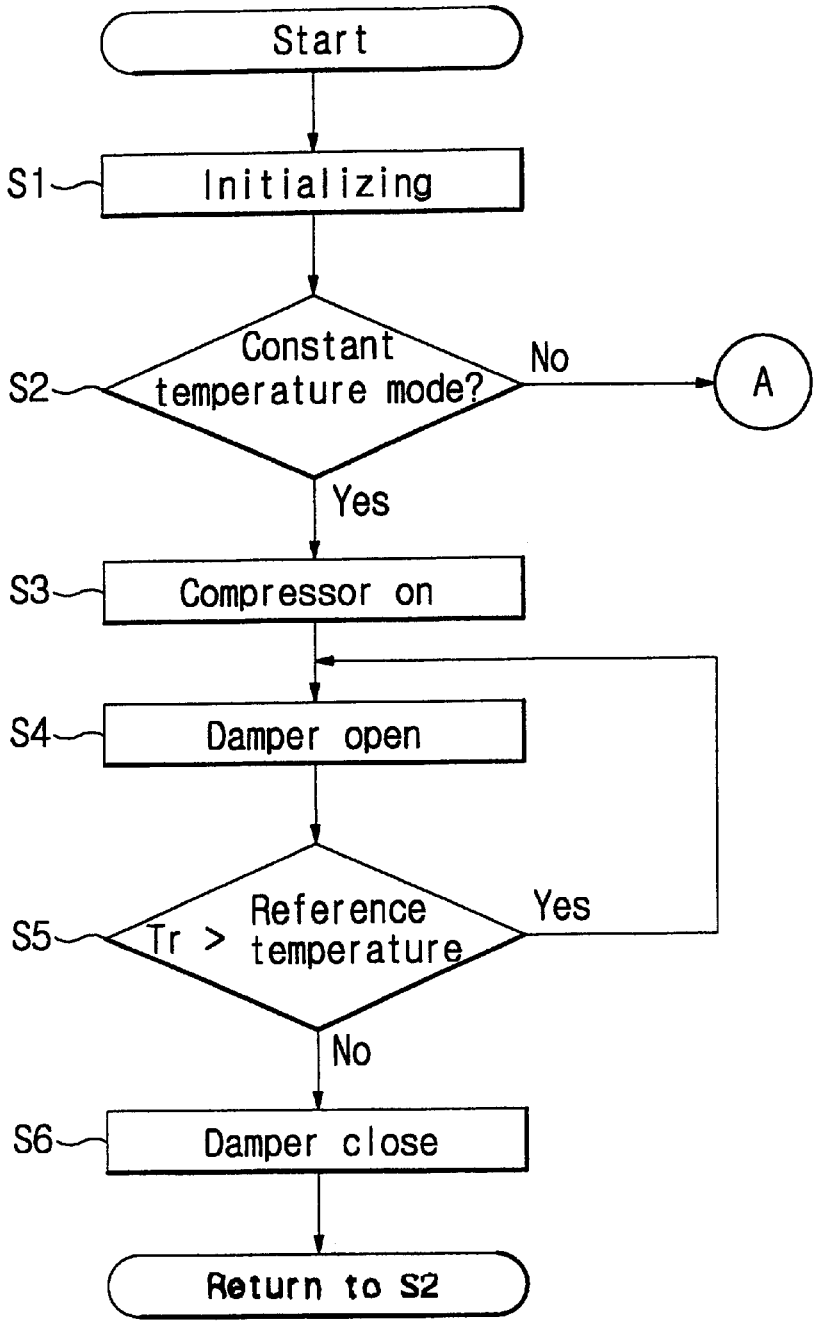
FIGS. 7A to 7C are flowcharts of the method of controlling the refrigerator with the multipurpose storage chamber shown in FIG. 2 in accordance with an embodiment the present invention.
Figure 7B:
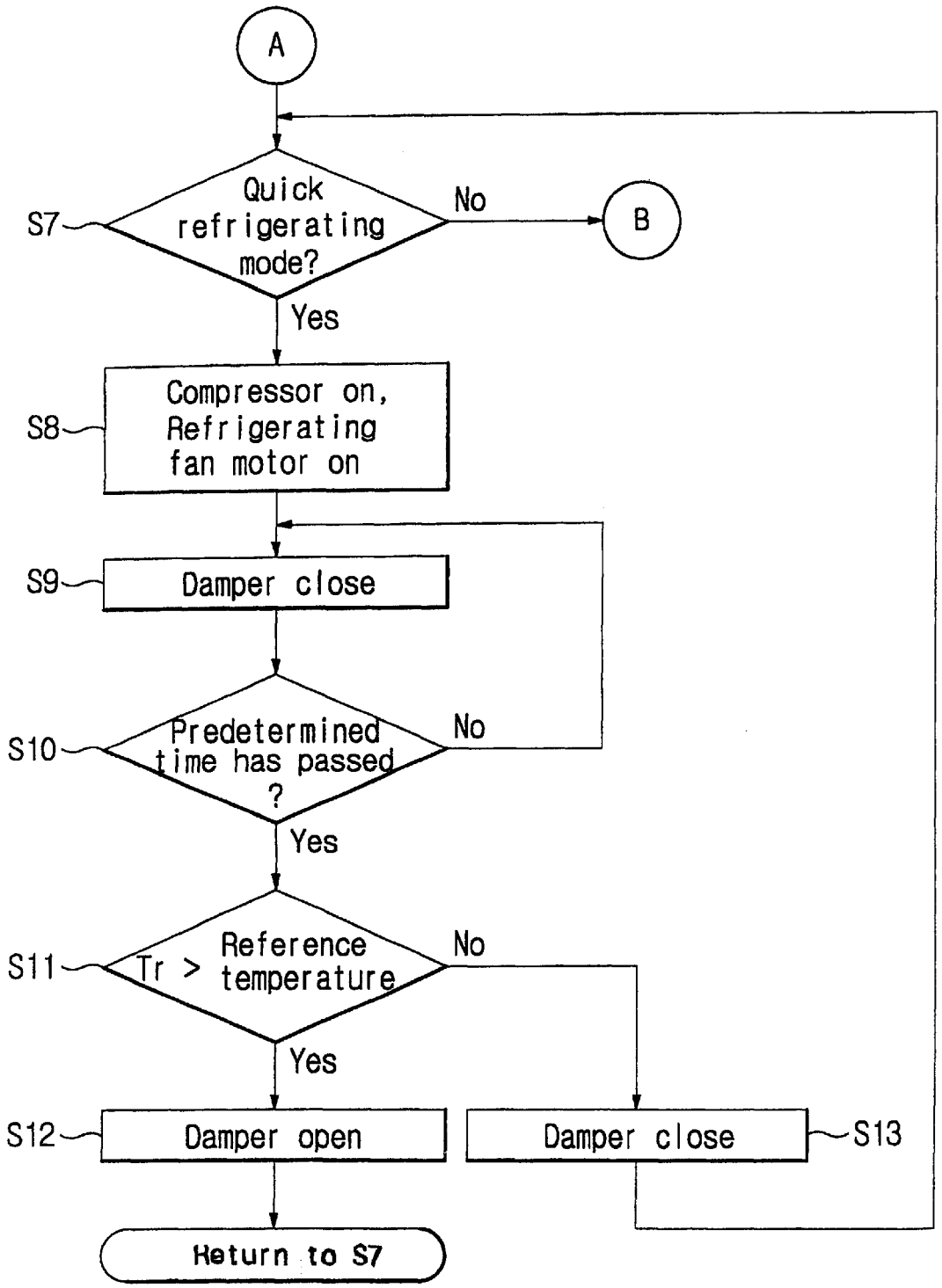
Figure 7C:
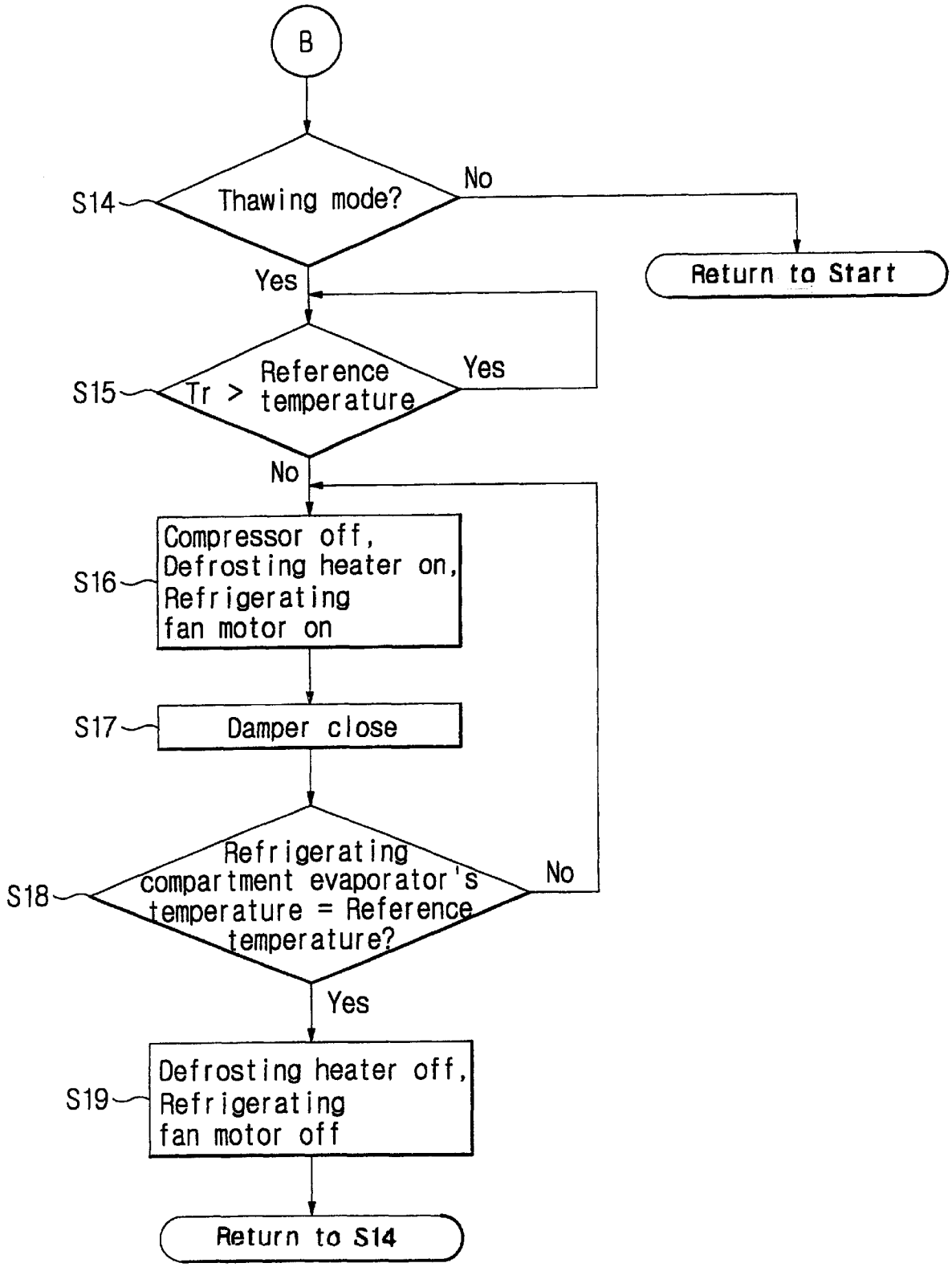

As illustrated in FIGS. 7A to 7C, the control unit 56 initializes the operation of the refrigerator in response to supplied electric power at S1. Thereafter, the control unit 56 determines at S2 whether a constant temperature mode has been selected. When it is determined that a constant temperature mode has been selected, the control unit 56 turns on both the compressor 1 and the refrigerating compartment fan 6 at S3, and opens the damper 9 at S4, thus performing a refrigerating compartment cooling operation of the constant temperature mode.

Thereafter, the control unit 56 determines at S5 whether the sensed temperature Tr of the refrigerating compartment 10 is higher than the preset reference point of the compartment 10. When the sensed temperature Tr of the refrigerating compartment 10 is higher than the preset reference point, the procedure is returned to S4, at which the control unit 56 continues the refrigerating compartment cooling operation. However, when the sensed temperature Tr of the refrigerating compartment 10 is not higher than the preset reference point, the control unit 56 closes the damper 9 at S6 prior to performing a return operation.

When it is determined, at S2, that a constant temperature mode has not been selected, the control unit 56 determines at S7 whether a quick refrigerating mode has been selected. When it is determined that a quick refrigerating mode has been selected, the control unit 56 turns on both the compressor 1 and the refrigerating fan motor 6*a* at S8, and closes the damper 9 at S9, and carries out a quick refrigerating mode operation for a predetermined period of time.

The control unit 56 determines at S10 whether the predetermined period of time has passed from the start of the quick refrigerating mode operation. When it is determined that the predetermined lengthy period of time has passed from the start of the quick refrigerating mode operation, the control unit 56 determines at S11 whether the sensed temperature Tr of the refrigerating compartment 10 is higher than the preset reference point of the refrigerating compartment 10. When it is determined that the sensed temperature Tr of the refrigerating compartment 10 is higher than the preset reference point, the control unit 56 opens the damper 9 at S12 so as to reduce the temperature of the refrigerating compartment 10 prior to returning to S2. However, when the sensed temperature Tr of the refrigerating compartment 10 is not higher than the preset reference point, the control unit 56 closes the damper 9 at S13, and returns to S7.

When it is determined at S7 that a quick refrigerating mode has not been selected, the control unit 56 determines at S14 whether a thawing mode has been selected. When it is determined that a thawing mode has not been selected, the control unit 56 performs a return to start. However, when it is determined, at S14, that a thawing mode has been selected, the control unit 56 determines at S15 whether the sensed temperature Tr of the refrigerating compartment 10 is higher than the preset reference point of said refrigerating compartment 10. When it is determined that the sensed temperature Tr of the refrigerating compartment 10 is higher than the preset reference point, the control unit 56 waits for a predetermined period of time prior to returning to S7 again. However, when the sensed temperature Tr of the refrigerating compartment 10 is not higher than the preset reference point, the control unit 56 turns off the compressor 1, and turns on both the defrosting heater 12 and the refrigerating fan motor 6*a* at S16, and closes the damper 9 at S17.

Thereafter, the control unit 56 receives a signal, indicating the defrosting temperature of the refrigerating compartment evaporator 5, from the defrosting temperature sensing unit 54, and determines at S18 whether the sensed temperature of the evaporator 5 has reached a preset reference point. When it is determined that the sensed temperature of the evaporator 5 has not reached the preset reference point, the control unit 56 returns to S16 so as to continue the thawing mode operation. However, when it is determined that the sensed temperature of the evaporator 5 has reached the preset reference point, the control unit 56 turns off both the defrosting heater 12 and the refrigerating fan motor 6*a* at S19 prior to performing a return operation.

As described above, the present invention provides a refrigerator with a multipurpose storage chamber and a control method thereof. In the refrigerator of this invention, the flow of cool air to the multipurpose storage chamber is selectively controlled in accordance with a variety of operational modes. Therefore, the multipurpose storage chamber of this refrigerator can be effectively used to store a variety of foods in accordance with storage characteristics of the foods. In addition, the thawing mode operation of the refrigerator is performed under the condition that it is not necessary to perform a refrigerating compartment cooling operation. It is thus possible to prevent an excessive increase in the temperature of the refrigerating compartment caused by an operation of the defrosting heater during such a thawing mode.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator, comprising:

a multipurpose storage chamber provided in a refrigerating compartment; and a cool air supply device controlling a flow of cool air to the multipurpose storage chamber in accordance with a selected operational mode.

2. The refrigerator according to claim 1, wherein said cool air supply device comprises:

a refrigerating compartment evaporator provided at a rear wall of said refrigerating compartment;

a refrigerating compartment fan provided at a position near said evaporator;

a damper selectively supplying the cool air flowing from said fan to said refrigerating compartment or said multipurpose storage chamber within said refrigerating compartment;

a flap provided at an inlet of a guide path guiding the cool air to the multipurpose storage chamber, said flap being controlled in an open angle thereof in accordance with a flow rate of the cool air; and a control unit controlling operations of said fan and said damper.

3. The refrigerator according to claim 2, further comprising:

a heater provided at said refrigerating compartment evaporator, wherein said control unit operates said heater during a thawing mode.

4. The refrigerator according to claim 3, wherein said control unit performs a thawing mode using the heater under the condition that a temperature of the refrigerating compartment does not become higher than a preset reference point.

5. The refrigerator according to claim 3, wherein when the thawing mode is selected, the cool air supply device is turned off, the refrigerating fan motor is turned on with the heater, and the damper is closed.

6. The refrigerator according to claim 5, further comprising a damper to selectively supply cool air to the refrigeration compartment or the multipurpose storage chamber.

7. The refrigerator according to claim 1, wherein a casing of the multipurpose storage chamber is made of a thermal insulating material.

8. The refrigerator according to claim 1, further comprising an air guide path, wherein the multipurpose storage chamber is detachably mounted thereto such that the cool air is guided to the multipurpose storage chamber.

9. The refrigerator according to claim 1, further comprising an inclined panel arranged at the upper portion of the multipurpose storage chamber and having a plurality of guide holes.

10. The refrigerator according to claim 9, wherein the inclined panel is made of a thermal insulating material.

11. The refrigerator according to claim 1, further comprising:

a key input unit to allow a user to input desired operational modes and desired reference temperatures of the freezing compartment and the refrigeration compartment;

a freezing temperature sensing unit to sense the temperature of the freezing compartment;

a refrigerating temperature sensing unit to sense the temperature of the refrigeration compartment; and a defrosting temperature sensing unit to sense the temperature of the refrigerating compartment evaporator during a defrosting mode.

12. The refrigerator according to claim 1, wherein the control unit opens the damper to allow the cool air to flow from the refrigerating compartment evaporator to the refrigerator compartment during a refrigeration compartment cooling operation.

13. The refrigerator according to claim 1, wherein the control unit performs a cooling operation for a predetermined period of time while closing the damper during a quick refrigeration mode such that most of the cool air from the refrigerating compartment evaporator flows to the multipurpose storage chamber through the flap.

14. A method of controlling a refrigerator with a multipurpose storage chamber provided in a refrigerating compartment and a cool air supply device controlling a flow of cool air to the multipurpose storage chamber, comprising:

determining an operational mode selected by a user; and selectively controlling the flow of cool air to the multipurpose storage chamber or the refrigerating compartment by an operation of said cool air control device in accordance with a selected operational mode, thus controlling a temperature of said multipurpose storage chamber.

15. The method according to claim 14, wherein air heated by a heater provided at a refrigerating compartment evaporator is supplied to the multipurpose storage chamber when the user selects a thawing mode.

16. The method according to claim 14, further comprising:

determining whether a constant temperature operation mode has been selected, and if so, turning on a compressor and a refrigeration compartment fan and opening a damper to perform a refrigeration compartment cooling operation of the constant temperature mode.

17. The method according to claim 16, further comprising:

determining whether a sensed temperature of the refrigerating compartment is higher than a preset reference point of the refrigerating compartment, and if so, then the refrigerating compartment cooling operation is continued, otherwise, closing the damper and performing the determining of whether a constant temperature operation mode has been selected again.

18. The method according to claim 16, wherein if it is determined that a constant temperature mode has not been selected, then performing the operation of determining whether a quick refrigerating mode has been selected, and if so, then performing the operation of turning on the compressor and the refrigeration fan motor and closing the damper for a predetermined period of time.

19. The method according to claim 18, wherein after the predetermined period of time has been reached, performing the operation of determining whether the sensed temperature of the refrigerating compartment is higher than a preset reference point, and if so, performing the operation of opening the damper to reduce the temperature of the refrigerating compartment and then returning to determining whether a constant temperature operation mode has been selected, otherwise, closing the damper and then returning to the operation of determining whether the quick refrigerating mode has been selected.

20. The method according to claim 18, wherein if it is determined that the quick refrigerating mode has not been selected, then performing the operation of determining whether a thawing mode has been selected, and if not, then performing the operation of determining an operational mode selected by a user, otherwise, performing the operation of determining whether the sensed temperature of the refrigerating compartment is higher than the preset reference point.

21. The method according to claim 20, wherein if it is determined that the sensed temperature of the refrigerating compartment is higher than the preset reference point, then performing the operation of waiting for a predetermined period of time before performing the operation of determining whether the quick refrigerating mode is selected, otherwise, performing the operation of turning off the compressor and turning on a defrosting heater and the refrigeration fan motor and closing the damper.

22. A refrigerator comprising:

a refrigeration compartment; and a multipurpose storage chamber provided in the refrigeration compartment, wherein a temperature of the refrigeration compartment external of the multipurpose storage chamber and a temperature of the multipurpose storage chamber internal thereof are selectively controlled independent of each other.

* * * * *